United States Patent [19]

Pointner

[11] 4,146,173

[45] Mar. 27, 1979

[54] FLY LEADER SLIDE RULE GUIDE

[76] Inventor: Jacqueline E. K. Pointner, P.O. Box 207, Montoursville, Pa. 17754

[21] Appl. No.: 610,714

[22] Filed: Sep. 5, 1975

[51] Int. Cl.[2] ..... G06G 1/02; G06C 3/00

[52] U.S. Cl. ..... 235/89 R; 235/70 A

[58] Field of Search ..... 235/69, 70 A, 85 R, 235/89

[56] References Cited

U.S. PATENT DOCUMENTS

| | | | |
|---|---|---|---|
| 2,130,967 | 9/1938 | Ross | 235/89 R |
| 2,171,873 | 9/1939 | Gould | 235/89 R |
| 3,335,948 | 8/1967 | Vorpahl | 235/70 R |
| 3,747,847 | 7/1973 | Cohen | 235/85 R |

*Primary Examiner*—Edith S. Jackmon

*Attorney, Agent, or Firm*—Sughrue, Rothwell, Mion, Zinn and Macpeak

[57] ABSTRACT

A slide rule guide enables immediate selection of the requisite individual different diameter, different length sections or segments of a multiple segment tapered fly fishing leader. An envelope forming side panels slidably receives a planar slide. A pair of elongated windows in line and at right angles to the direction of slide movement simultaneously display common columnar data on the face of the slide; the overall length of the leader, the tippet size, and in order from the butt end of the leader to the tippet end, the length and diameter of each leader segment or section.

5 Claims, 4 Drawing Figures

FLY LEADER SLIDE RULE GUIDE

BACKGROUND OF THE INVENTION

1. Field of the Invention

This invention relates to a slide rule guide relating to a multiple segment fly fishing leader, and more particularly, to a guide that may be readily used by a fisherman to ascertain when tying up a tapered multiple section fishing leader, the number of sections, the length and diameter of each section dependent upon the overall length of the leader to be formed and the tippet size.

2. Description of the Prior Art

Dry and wet fly fishing for trout and other game fish is enjoyed by millions of people throughout the world and the art of dry fly fishing particularly has become highly sophisticated. In the casting of a dry fly, it is necessary, particularly when fishing clear water, to employ a monofilament or natural gut translucent leader as an extension of the fishing line itself. The butt end is of large diameter and smaller than the diameter of the fly line to which it is tied or otherwise attached. The end of the leader remote from the line is the tippet and is of the smallest diameter, and the dry fly or wet fly as the case may be is tied directly thereto.

Attempts have been made to manufacture fly leaders of continuous monofilament whose diameter varies so as to produce a tapered fly leader. Such fly leaders have not provided the desired action to the line, leader and fly, both during casting and laying the fly, the leader and the line on the water at the termination of casting.

Historically, tapered fly leaders have been constructed of natural gut segments or sections which are tied together by an appropriate knot with the individual sections being of constant diameter, and wherein the fisherman or manufacturer tieing up the leader has selected given lengths of natural gut or monofilament plastic material of different diameters and has created leaders of a desired length having a preselected tippet diameter, that is, a diameter at the point where the leader is tied to the fly and which is smaller than the other sections. As the water, particularly in the summer time, gets lower and clearer, it is necessary to employ leaders of extended length and tippet sizes which are much smaller in order to fool the game fish into believing that the fly is unattached. The size of the tippet is determined partially by the size and fighting ability of the game fish, with the smaller size tippets being employable for the smaller fish.

Further, in order to create a fly leader which delivers the fly as naturally as possible to the water and permits the leader to act as a true and straight extension of the line, the leader section closest to the line, that is, the butt end of the leader, must be somewhat stiffer than those sections near the fly end or tippet end of the leader. This is another reason why continuous monofilament tapered leaders have not been found to be satisfactory in the field. This had lead to the return to hand tieing of leaders by sections of leader material of particular size and flexibility. Thus, leader sections which come in given diameter may vary in length and also may vary in flexibility, there being two general types known as "soft" and "hard" test material. The breaking strength of leader material is inverse to hardness. The harder material tends to break easier than the soft material for a given diameter.

For these reasons, it is difficult for a fisherman or even a manufacturer manufacturing hand tied leaders to properly select the diameter size and the leader section length for a multiple section tapered leader even though he may know the overall length of leader desired and the tippet size which determines the ultimate breaking strength.

SUMMARY OF THE INVENTION

The present invention is directed to a slide rule guide for the selection of the individual sections of a tapered multiple section, hand tied fly fishing leader. The slide rule guide comprises an envelope forming side panels. A slide is slidably positioned within the envelope, between the panels with faces opposing respective panels. One of the panels is formed with at least one window which is elongated in the direction at right angles to the direction of slide movement within the envelope to display columnar, numerical indicia carried by the face of the slide and viewable through the window. The columnar indicia carried by the slide face at multiple column positions comprise indicia given overall length, tippet size, and in order, the number, length and diameter of each leader section.

Preferably, a pair of aligned, elongated windows are employed and columnar indicia to the sides of the windows on the envelope panel identifies the numerical columnar information appearing within the window in terms of overall leader length, the tippet size, and section diameter.

The face of the envelope panel adjacent the windows further carries numerical indicia identifying the pound pulling test or breaking strength of the leader sections at column positions correlated to the diameter size of both soft and hard leader material. The columnar section length numerical indicia columns each preferably, carry a line separating the soft from the hard leader sections, the hard leader material forming the butt end of the leader and the soft leader material forming the tippet end.

For a full and more complete understanding of the invention, reference may be had to the following description and accompanying drawings.

DESCRIPTION OF THE PREFERRED EMBODIMENT

Figure 2:
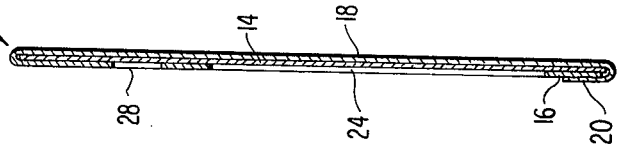
FIG. 2 is a sectional view of the slide rule guide of FIG. 1 taken about line II—II.

Referring to the drawings, the slide rule guide of the present invention is indicated generally at 10, and comprises essentially two components: an envelope 12 and a slidably inserted slide 14. Both the envelope 12 and the slide 14 are formed of plastic material of sheet form, however, the elements 12 and 14 may be formed of cardboard, paper or metal as desired.

The envelope 12 consists of a front panel 16, a rear panel 18, all of which may be formed by bending a single sheet of plastic material with the rear or bottom panel 18 being wrapped around the edge of the front panel 16 to form a lip 20 which slightly overlaps panel 16. In the illustrated embodiment of the invention, only the front panel 16 is apertured. In this case, it is provided with two aligned openings, an upper elongated window 22 and a lower elongated window 24. The windows are elongated in a direction generally at right angles to the direction of slide movement 14 relative to the envelope 12. In use, the slide rule guide may lie flat or it may be held in the hand in generally upright position, and the description of the indicia and its appearance on both the envelope 12 and the slide 14 will be described in terms of upright conditions of use. In that regard, therefore, with respect to opening or window 22, within panel 16 of the envelope, the abbreviation "Lgt" appears at 26 to the left of the window at the top to identify certain columnar numerical indicia or information which may be viewed through window 22 and which appears on the face of the slide 14 opposite the window. To the right and horizontally in line with the abbreviation for length "Lgt" is the abbreviation "Ft" for foot, this identifying the indicia positions on the face of the slide 14 related to the overall length of the fly fishing leader, in feet. In terms of the columnar indicia appearing on the slide 14, only two numerals will be seen within window 22, the upper numeral giving the overall length of the fly fishing leader and the lower numeral giving the tippet size of the leader, that is, the smallest diameter section of the leader, remote from the butt end of the leader which is joined to the fishing line itself. In that regard, the word "size" appears at 30 to the left of the window 22 adjacent the lower left hand corner, while at 32 to the right of the window at the same horizontal position appears the designation "X/LB" which is the tippet size in terms of pound strength for the game with which the fishing leader is to be employed. It should be explained that fishing leaders are generally designated both in terms of their overall length and their tippet size being 0X, 1X, 2X etc., through 7X for the highly popular fresh water fishing. Immediately below the indicia designation of size, appears the printed designation "Dia. In." which is the diameter in inches for conventionally available fly fishing leader section material, that is, the columnar data on the slide appearing within the lower window 24 gives the length of the leader sections making up the multi-segment fly leader relative to their diameter. Possible diameter size of the sections of leader material to form the tapered dry fly leader is provided in columnar form at 42, beneath the printed indicia 34 The available leader material is printed in fourteen different diameters starting at 0.032 inches and terminating at 0.004 inches this data forming a base scale for the slide rule.

Separating the upper window 22 from the lower window 24 is a section of the panel 16 which carries printed indicia as at 36 which is the abbreviation "Lgt. In.", meaning the length in inches of the individual sections of fly leader material of selected diameter, this being the numerical data which appears on slide 14 within window 24 for the individual sections of fly leader, proper for a given leader of overall length and the tippet size as designated within window 22 immediately above window 24 and within the same column of slide 14.

To the right of indicia 36 and below the indicia 32 is a column designation indicia 36 of the pound test strength of each of the possible leader sections corresponding to material diameter data 42. This numerical data is the breaking strength in pounds of the soft type of leader material. Indicia 38 comprises an abbreviation of the pound test of hard leader monofilament material.

The hard test material strengths for the various diameters of available leader material form a column at 46 which shows pound tests of 40 pounds for 0.032 inch diameter hard monofilament leader material down to 3 pounds for a 0.009 inch diameter leader section.

Figure 1:
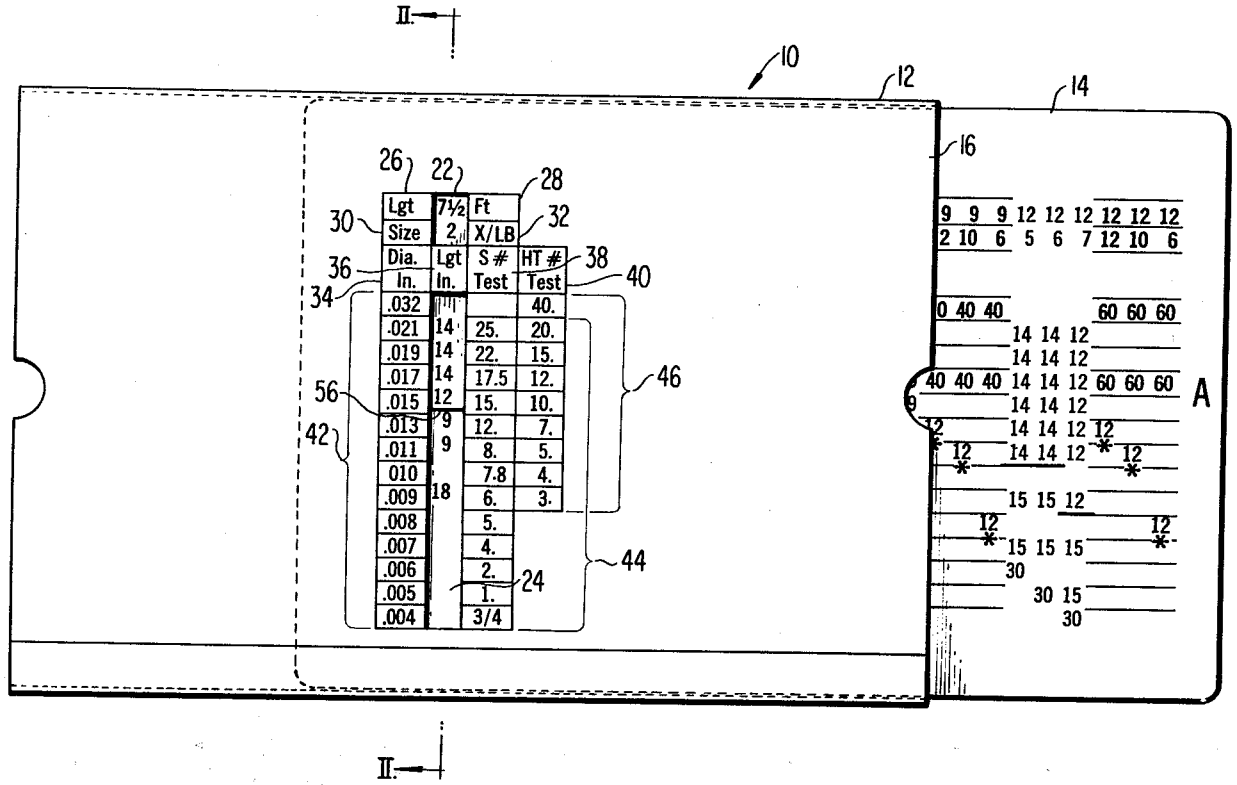
FIG. 1 is a front elevational view of the slide rule guide for a multiple secton, hand tied fly fishing leader of the present invention, with the slide at a selected display position.
Figure 3:
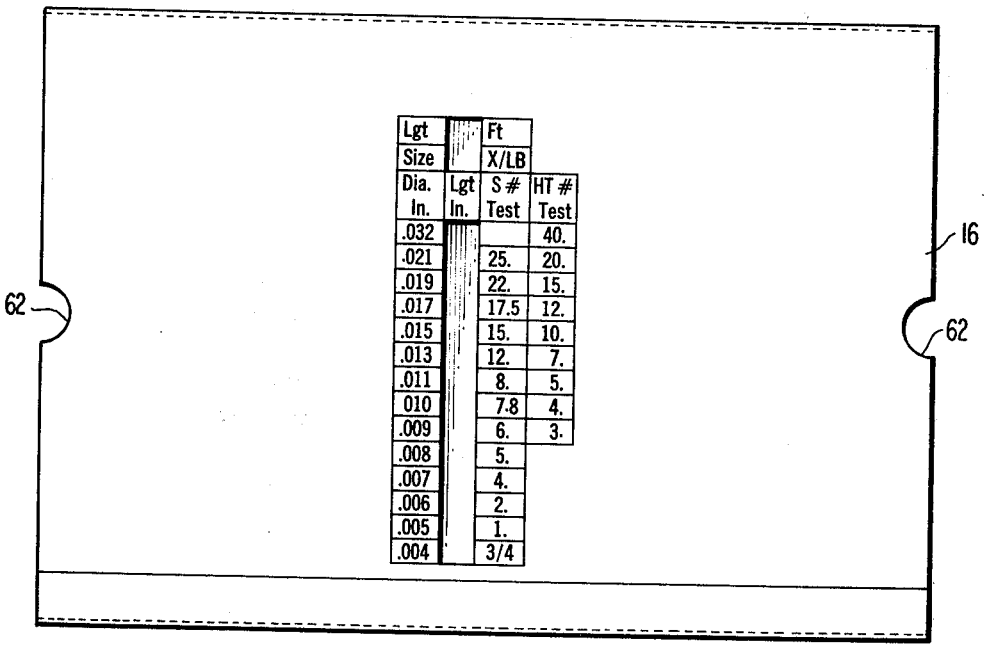
FIG. 3 is a front elevational view of the slide rule guide similar to that of FIG. 1 with the slide removed.
Figure 4:
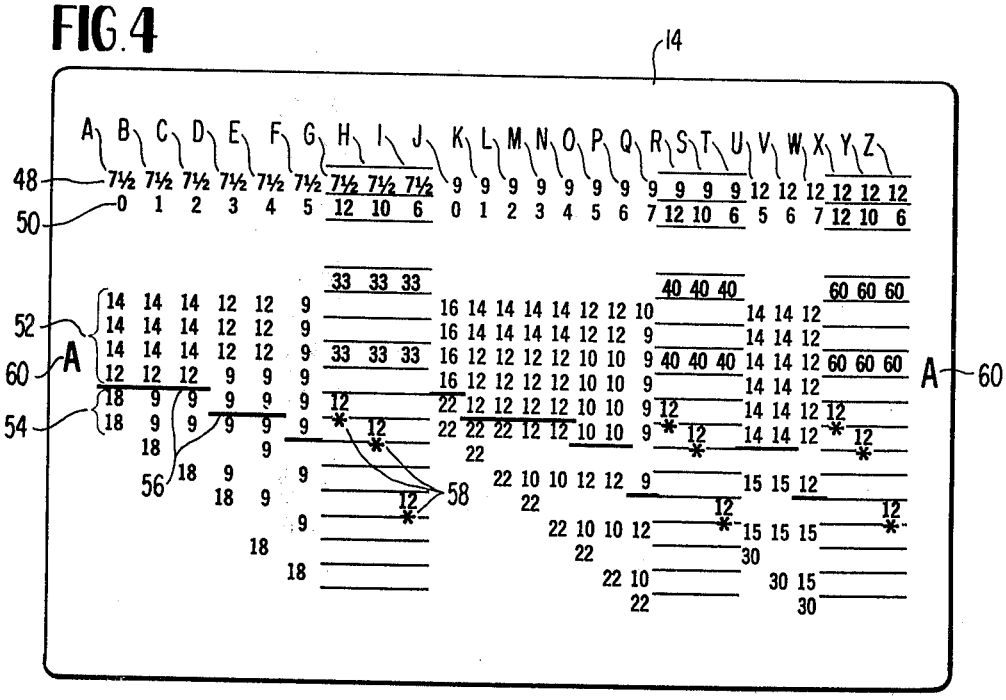
FIG. 4 is a front elevational view of the slide rule guide of FIG. 1.

Leaving FIGS. 1 and 3 and going to FIG. 4 for the moment, the slide 14 carries on its face which underlies the windows 22 and 24, columnar information in a series of vertically spaced, horizontally spaced vertical columns identified at A, B, C, etc., from left to right, through Z. In this regard, taking column A as an example, at the top of the column, the numerical data 48 which numeral is 7½ in this column, identifies the total length of the leader as 7½ feet. Immediately below this data 48 in the next succeeding data position is the tippet size data. In this case, the tippet size is "O" X. Spaced somewhat below the "0" is a series of numerals in two sections 52 and 54, the upper section being numerals 14, 14, 14, and 12, being a portion of that information appearing within window 24 and identifying the length of a given number of hard monofilament leader sections, the length of each leader section being given in terms of a particular leader material diameter as at 42 to the left of window 24 on envelope panel 16. The horizontal black lines 56 appearing on the face 14 of the slide separates vertically, the sections of hard leader material from soft leader material. Hard leader material at the portion of the column identified at 52 lies above line 56 and soft leader material data 54 appears below the horizontal line 56 in each instance.

In this manner, the columnar numerical data from columns A, B, C, D, etc., from left to right, continues across the slide for all normal leader lengths and from 7½ through 12 feet, and for tippet sizes 0X through 7X for fresh water fly fishing leaders as well as salt water leaders. In this regard, columns A–F, J–Q, and U–W inclusive, relate to fresh water leaders, and G–I, R–T and X–Z relate, inclusive, to salt water. Further, while the columnar information relative to the salt water leader is generally the same as that for fresh water leaders, but is instead of giving the tippet size X designation, as at 0X–7X for fresh water, the tippet size is given in pounds directly. In this case, the breaking test of the tippet is 12 pounds, in column G, and further down in the column the diameter size for the three section fly leader is given as; 0.032 inch diameter section 33 inches in length, 0.017 diameter section 33 inches in length, and a final section being of 0.013 inches in diameter and being 12 inches in length. In this respect, an asterisk (*) appears immediately below the numeral 12 in that column, the asterisk 58 in each case designating the fact that of necessity for record keeping organizations, the tippet length must be at least 12 inches long.

The only other indicia appearing upon the face of the slide 14 are the letters A appearing at 60, these corresponding to notches 62 formed within the panels 16 and 18 of the envelope, the notches being provided so that the operator can readily grasp at positions A, the slide which otherwise is completely covered by the envelope.

It should be remembered that the figures appearing in the slide rule guide are average figures in terms of the test strength of the leader section material. The columnar numerical data at 44 and at 46 represent the average breaking strength of soft type S monofilament material and average breaking strength for the hard type HT monofilament material. A variation in diameter and pound test occur due to the variances in manufacture of the monofilament material employed in making up the leaders and thus the figures within the columns are averages only.

In operation, the manner of positioning the slide 14 with respect to the envelope should be apparent from viewing the figures. However, it may be seen that from FIG. 1 that the columnar information of column C appears within windows 22 and 24 of envelope panel 16, thus displaying the numerical indicia 48 and 50 of that column; specifically a 7½ foot fresh water fly leader, of 2X tippet size. The leader is formed of six different sections of monofilament leader material, four of which are hard test monofilament material sections, the first three from the butt end of the leader towards the tippet end being 14 inches in length and comprising sections 0.021 inches in diameter, 0.019 inches in diameter, and 0.017 inches in diameter, the last of the hard test leader material being 12 inches in length and of a diameter of 0.015 inches. The soft material prior to the tippet itself comprises two lengths of nine inches each, the first coupled to the 12 inch 0.015 diameter section of monofilament being 0.013 inches in diameter and the next section being 0.011 inches in diameter. The tippet itself is formed of 2X material and has a diameter of 0.009 inches and is 18 inches in length. Horizontal line 56 within window 24 separates the soft monofilament material sections from the hard monofilament material sections.

While a 2X, intermediate size tippet, leader of 7½ foot length was selected for illustration in FIG. 1, it may be seen by reference to FIG. 4 that fish for spring trout fishing when the leader is not too visible to the fish due to the fact that the waters are cloudy, or where a relatively large fly is employed or where the size of the fish is realtively large, a leader whose construction is identified in column A may be employed, terminating in a 0X tippet size, while for late summer a leader may be formulated by reference to column F where the tippet size is 5X, the number of sections are increased but their lengths individually are reduced to maintain the 7½ foot overall length but tapered to a much smaller diameter size tippet than that identified in column A, FIG. 4. In each case, a leader tied up as directed will cast easily and insure proper straightening of the leader on the water at the end of the cast with a soft drop on the water.

While the invention has been particularly shown and described with reference to a preferred embodiment thereof, it will be understood by those skilled in the art that various changes in form and details may be made therein without departing from the spirit and scope of the invention. For instance, it is envisioned that all possible leader section lengths may form the columnar indicia on the envelope panel adjacent the window and the slide may carry numerical data at selected column positions of leader diameter for a predetermined number of leader sections making up a given overall length fly leader.

What is claimed is:

1. In a slide rule giving the length and size selection of a plurality of monofilament sections of a tapered fly fishing leader including: an envelope forming side panels, a slide slidably positioned within said envelope between the panels and having faces opposing respective panels, the improvement comprising:

at least one window formed within one panel of said envelope elongated at right angles to the direction of slide movement to display columnar data, and said panel carrying adjacent to said window, a first column of numerical data, parallel to the longitudinal axis of said window and forming a base scale of possible leader material diameters in a given order, and said slide carries on its face underlying said window, numerical data in multiple columnar form and including for each column, the overall length of leader to be formed and the tippet size, and at selected positions laterally alignable with corresponding diameter data from said scale, the length of given, individual selected leader sections;

whereby, positioning of said slide relative to said envelope immediately displays for a given leader overall length and tippet size, only the number of leader sections, the length of those sections and the requisite leader diameter for each leader section corresponding to a given leader of prescribed length and tippet size.

2. The slide rule guide as claimed in claim 1, wherein said numerical data indicative of the overall length of the leader and the tippet size are spaced from the columnar data given individual section length, and said envelope includes two vertically spaced and aligned elongated windows, one of which displays only said overall length and tippet size data and said other displays the individual section length data.

3. The slide rule guide as claimed in claim 2, further comprising second and third columns of numerical data on said panel to the side of the window displaying leader section lengths in side by side fashion indicative of the breakage strength of respective leader sections for soft and hard leader material, and said slide includes demarcation means on the face thereof separating the columnar data of leader section length into sections pertaining to soft leader material and hard leader material, respectively.

4. The slide rule guide as claimed in claim 3, wherein said demarcation means comprises a horizontal line separating the numerals related to hard monofilament material from that of the soft monofilament material.

5. The slide rule guide as claimed in claim 4, wherein said windows comprise an upper, shorter length window separated from a lower larger length window, and the portion of said envelope panel therebetween carries indicia indicating the lower, elongated window as displaying selected leader sections in terms of length.

* * * * *